US005291665A

United States Patent [19]

Yoshikawa

[11] Patent Number: 5,291,665

[45] Date of Patent: Mar. 8, 1994

[54] DRYING METHOD AND APPARATUS USING HOT D.I. WATER

[75] Inventor: Haruo Yoshikawa, Kanagawa, Japan

[73] Assignee: Speedfam Clean Systems, Co., Ltd., Ayase, Japan

[21] Appl. No.: 771,503

[22] Filed: Oct. 4, 1991

[30] Foreign Application Priority Data

Nov. 29, 1990 [JP] Japan ..... 2-332595

[51] Int. Cl.[5] ..... F26B 3/00

[52] U.S. Cl. ..... 34/9; 34/27; 34/15; 34/32

[58] Field of Search ..... 34/9, 12, 48, 60, 61, 34/27, 32, 15, 92, 164, 72

[56] References Cited

U.S. PATENT DOCUMENTS

| | | | |
|---|---|---|---|
| 3,365,807 | 1/1968 | Williamson | 34/9 |
| 3,386,181 | 6/1968 | Steinacker | 34/9 |
| 3,559,297 | 2/1971 | Figiel | 34/9 |
| 3,710,450 | 1/1973 | Figiel | 34/9 |
| 3,886,668 | 6/1975 | Remond et al. | 34/9 |
| 4,090,307 | 5/1978 | Gollmick et al. | 34/9 |
| 4,307,518 | 12/1981 | Izumo et al. | 34/9 |
| 4,745,690 | 5/1988 | Koop et al. | 34/9 |
| 4,876,801 | 10/1989 | Gehring et al. | 34/9 |

FOREIGN PATENT DOCUMENTS

| | | |
|---|---|---|
| 56-209686 | 3/1981 | Japan . |
| 62-21192 | 4/1987 | Japan . |

*Primary Examiner*—Henry A. Bennett
*Assistant Examiner*—Denise L. Gromada
*Attorney, Agent, or Firm*—Fitch, Even, Tabin & Flannery

[57] ABSTRACT

Described herein are method and apparatus using a hot D.I. water bath for drying a wet work, for example, for draining and drying a wet work to dissipate water droplets completely from the work surface subsequent to a washing operation, permitting a high precision drying operation precluding disturbances by air bubbles of the water surface at the time of lifting the work out of the hot D.I. water bath. Prior to sending D.I. water to a heater, it is passed through a deaerator to reduce dissolved gas content to a level lower than a saturated solubility at a given temperature, and then heated to a predetermined temperature to prepare hot D.I. water for supply to the hot D.I. water bath; or alternatively D.I. water is heated to a predetermined temperature and supplied to a hot D.I. water bath through a water feed conduit via a bubble trapping chamber to remove air bubbles therefrom. A wet work is heated by immersion in the hot D.I. water bath and then lifted up to drain and dry same.

12 Claims, 4 Drawing Sheets

DRYING METHOD AND APPARATUS USING HOT D.I. WATER

BACKGROUND OF THE INVENTION

1. Field of the Invention

This invention relates to drying method and apparatus to be used after a washing stage for draining and drying a wet work of metal, glass, plastics etc. by the use of hot D.I. (deionized) water to dispel water droplets completely from the work surface, and more particularly to a method and an apparatus of high precision drying capable of lifting a work out of a hot D.I. water bath free of disturbance of the water surface by air bubbles.

2. Description of Prior Art

For example, Japanese Laid-Open Patent Application No. 58-184479 discloses a draining and drying method in which a flat plate-like article with a smooth surface of metal, glass, plastics or the like is put in a bath of heated water or in a bath of pure or D.I. water and then lifted out of the bath at a predetermined speed based on an empirical value as determined article by article.

Also disclosed in Japanese Laid-Open Patent Application No. 64-53549 is a drying method with hot D.I. water, wherein a wet workpiece which has come out of a washing stage is immersed in hot D.I. water of a predetermined temperature and then lifted up slowly to dry the workpiece by its own heat.

In such a drying operation using a hot D.I. water bath, it is an utmost importance to maintain the water surface always in a still state without rippling the water surface, because the pull-out speed of the work relative to the water surface will be varied to deteriorate the drying accuracy when the water surface is disturbed by waves. Namely, when the water surface is moved up and down by waves, the work pull-out speed relative to the water surface becomes faster or slower, bringing the same portion of the work irregularly into repeated contact with the water surface to increase the possibilities of staining and uneven drying of the work surface.

In an actual hot D.I. water bath drying operation, there has been a problem that, when heating D.I. water by the use of a heater to prepare hot D.I. water, the air bubbles which are generated on the surface of the heater or in hot D.I. water creep into a hot D.I. water bath along with the feed water and float up to the water surface to cause rippling of the water surface. Therefore, when drying a work with use of hot D.I. water, it is necessary to prevent rippling of the water surface which is caused by air bubbles.

SUMMARY OF THE INVENTION

It is an object of the present invention to enhance the accuracy of drying operation by preventing rippling of the water surface which is caused by air bubbles in the hot D.I. water drying in which a work is dried by the use of hot D.I. water.

In accordance with an aspect of the present invention, the above-stated objective is achieved by a method of drying with hot D.I. water, which comprises: removing dissolved gases from D.I. water by deaeration to a level below a saturated gas solubility at a predetermined temperature; heating deaerated D.I. water to the predetermined temperature by the use of a heater; supplying resulting deaerated hot D.I. water to a hot D.I. water bath; immersing a wet work in the hot D.I. water bath; and lifting the work out of the bath to drain and dry same.

According to another aspect of the present invention, there is provided a method of drying with hot D.I. water, which comprises: heating D.I. water to a predetermined temperature; supplying hot D.I. water to a hot D.I. water bath through a water supply conduit with a bubble trapping chamber to remove air bubbles therefrom; immersing a wet work in the hot D.I. water bath; and lifting up the work out of the bath to drain and dry same.

According to the invention, there is also provided an apparatus for carrying out the first-mentioned method, the apparatus including a hot D.I. water bath for immersing a work, and a hot D.I. water supply means for supplying hot D.I. water of a predetermined temperature to the bath, the hot D.I. water supply means comprising: a D.I. water source; a deaerator for removing dissolved gases from D.I. water to be supplied to the bath; a densitometer for measuring dissolved gas concentration in D.I. water coming out of the deaerator; a controller adapted to control the deaerator to hold the dissolved gas concentration in D.I. water to a level below a saturated gas solubility at a given temperature, on the basis of the dissolved gas concentration measured by the densitometer and the temperature of hot D.I. water; and a heater for heating up deaerated D.I. water to a predetermined temperature level.

The deaerator may be constituted by a D.I. water passage formed of a gas permeable membrane permitting passage of gases but not of a liquid, and a reduced pressure chamber circumventing the D.I. water passage, stripping and sucking dissolved gases out of D.I. water flowing in and along the D.I. water passage through the gas permeable membrane while evacuating the reduced pressure chamber by means of a vacuum pump.

In another preferred form of the invention, the deaerator is provided with a deaeration vessel which is connected to a vacuum pump, and D.I. water is stripped of dissolved gases within the deaeration vessel under reduced pressure.

In another form of the invention, the deaerator is provided with an ultrasonic transducer within a deaeration vessel, deaerating D.I. water by applying ultrasound energy to D.I. water which flows into the deaeration vessel.

According to the invention, there is further provided an apparatus for carrying out the second method mentioned above, the apparatus including a hot D.I. water bath for immersing a work therein, and a hot D.I. water supply means for supplying hot D.I. water of a predetermined temperature to the bath, the hot D.I. water supply means comprising a heater for heating up D.I. water to a predetermined temperature; and an air bubble trapping chamber adapted to collect air bubbles which are generated in D.I. water being heated.

The above and other objects, features and advantages of the invention will become apparent from the following description and the appended claims, taken in conjunction with the accompanying drawings which show by way of example preferred embodiments of the invention.

DESCRIPTION OF PREFERRED EMBODIMENTS

Figure 1:
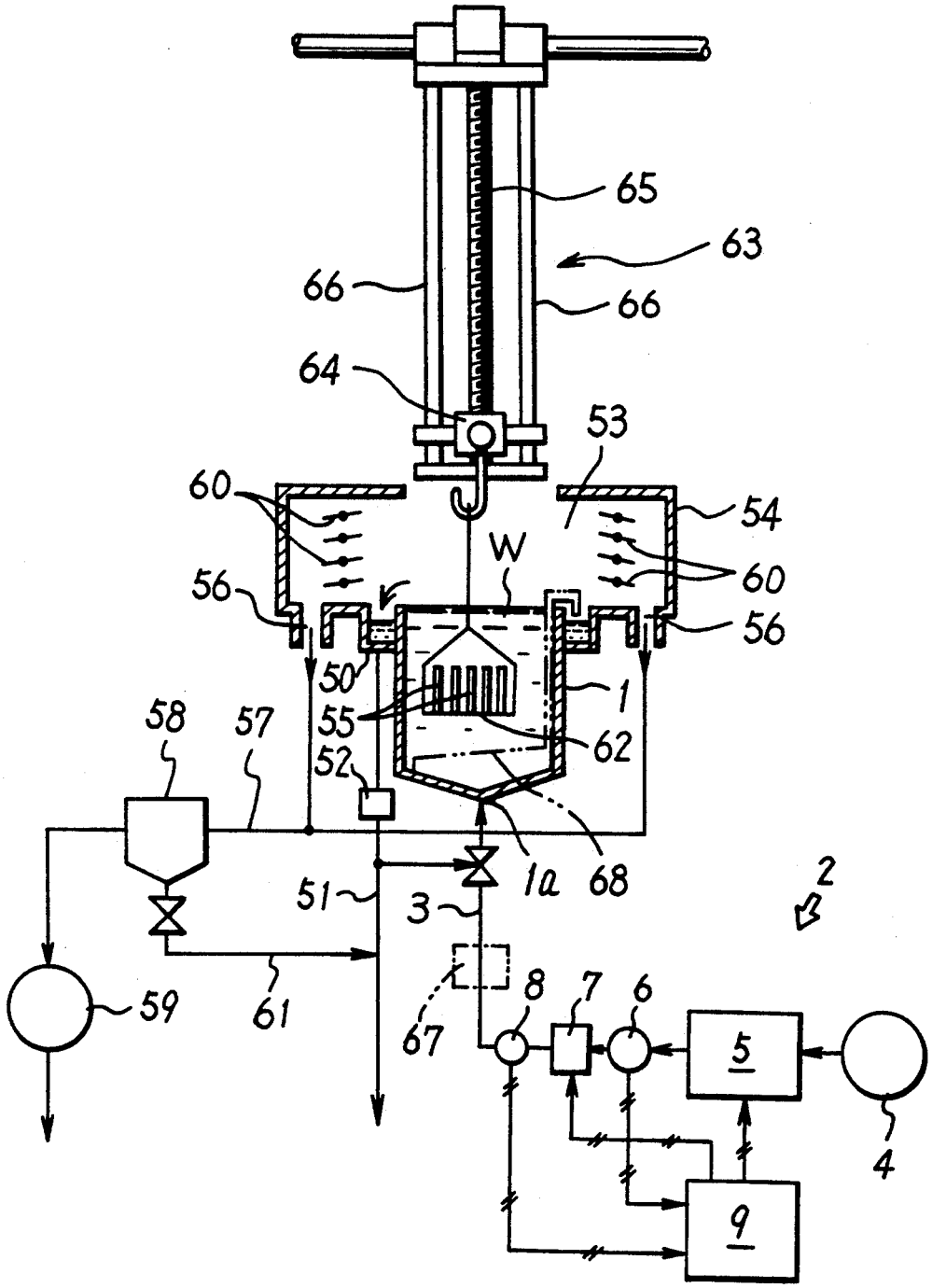
FIG. 1 is a sectional view of an embodiment of the apparatus for drying with hot D.I. water according to the present invention.

Referring to FIG. 1, the reference 1 denotes a hot D.I. water bath which holds hot D.I. water W therein and which is provided with a hot D.I. water inlet 1*a* at its bottom. The water inlet 1*a* is connected to a hot D.I. water supply means 2 through a water supply conduit 3. The hot D.I. water supply means 2 includes a D.I. water source 4 which supplies D.I. water free of impurities, a deaerator 5 for removing dissolved gases from D.I. water, a densitometer 6 for measuring the dissolved gas concentration in D.I. water coming out of the deaerator 5, a heater 7 for heating up deaerated D.I. water to a predetermined temperature, a temperature sensor 8 for measuring the D.I. water temperature, and a controller 9 which controls operations of the deaerator 5 and heater 7. D.I. water from the D.I. water source 4 is sent to the heater 7 after deaeration to make hot D.I. water W of a predetermined temperature, which is continuously fed to the hot D.I. water bath 1 at a constant rate.

The controller 9 has a function of turning on and off the heater 7 to maintain the heated water temperature at a predetermined level according to the predetermined temperature and the actual temperature measured by the temperature sensor 8, and a function of controlling the deaerator 5 in such a manner as to maintain the dissolved gas concentration in D.I. water to be supplied to the heater 7 to a level below the saturated gas solubility at the predetermined temperature on the basis of the dissolved gas concentration in D.I. water measured by the densitometer 6 and the preset water temperature.

The deaerator 5 may be of any arbitrary principles and construction, for example, may be any one of the deaerators as exemplified in FIGS. 2 through 5.

Figure 2:
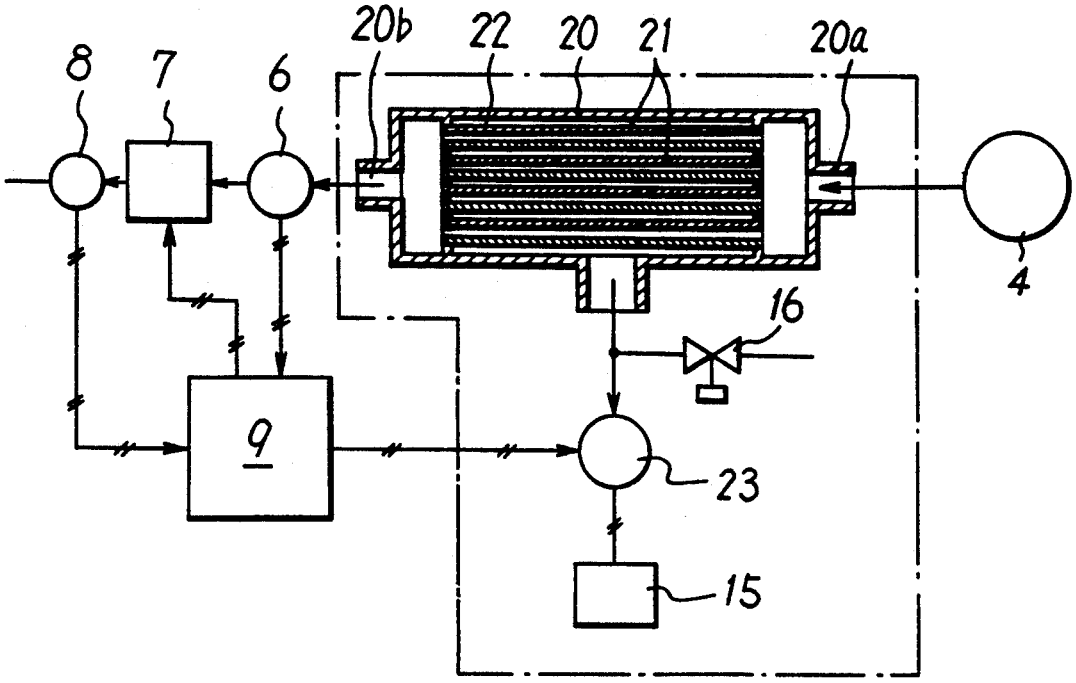
FIG. 2 is a schematic view of a hot D.I. water supply means.

The deaerator 5 shown in FIG. 2 is a membrane type deaerator which employs a gas permeable membrane for deaeration. More specifically, the deaerator 5 has a cylindrical casing 20 which is provided with D.I. water inlet 20*a* and outlet 20*b* and accommodates therein a large number of air separator tubes 21. Each air separator tube 21 is constituted by a ga permeable membrane which permits passage of gas but does not permits passage of water therethrough and has the opposite ends thereof in communication with the D.I. water inlet 20*a* and outlet 20*b*, respectively. A reduced pressure chamber 22 which circumvents the air separator tubes 21 is connected to a vacuum pump 23. While D.I. water enters the deaerator through the inlet 20*a* and flows toward the outlet 20*b* through the air separator tubes 21, dissolved air in D.I. water is sucked into the reduced pressure chamber 22 through the walls of the air separator tubes 21 and discharged. In this instance, similar results can be obtained by pressurizing D.I. water which flows through the air separator tubes 21.

Figure 3:
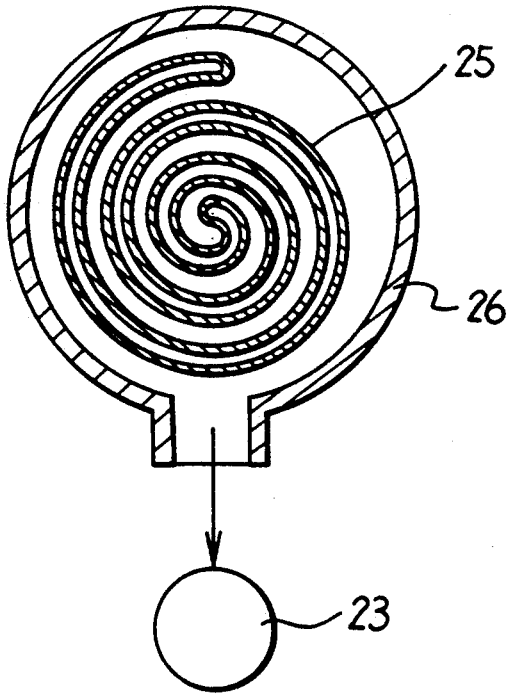
FIG. 3 is a sectional view of a modified deaerator for the hot D.I. water supply means of FIG. 2.

In place of the air separator tubes 21, there may be provided a hollow air separator sheet 25 of a gas permeable membrane, which is accommodated in a spirally rolled shape within a casing 26 as shown in FIG. 3, passing D.I. water through the inner side of the sheet 25 for deaeration.

Figure 4:
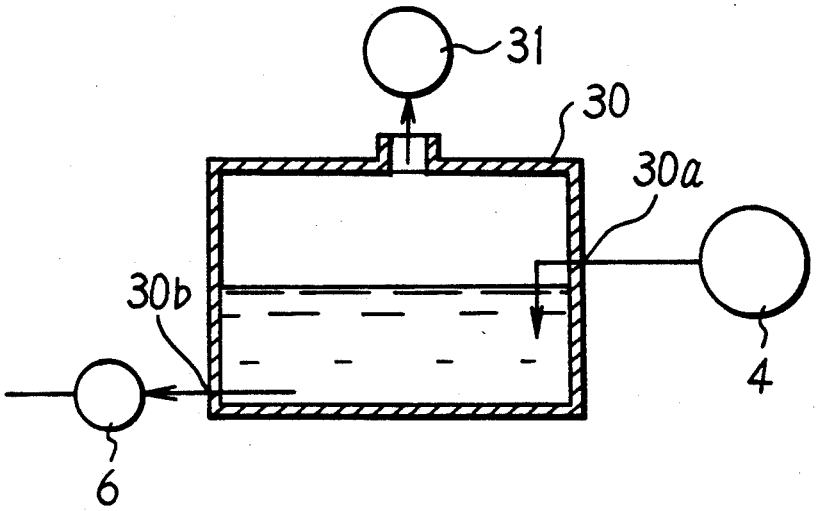
FIGS. 4 and 5 are sectional views of further modifications of the deaerator.

Alternatively, the deaerator 5 may be a reduced pressure type deaerator as shown in FIG. 4, having a vacuum pump 31 connected to a deaeration vessel 30 with D.I. water inlet 30*a* and outlet 30*b*, removing dissolved gases from D.I. water by evacuating the deaeration vessel 30 through the vacuum pump 31.

Figure 5:
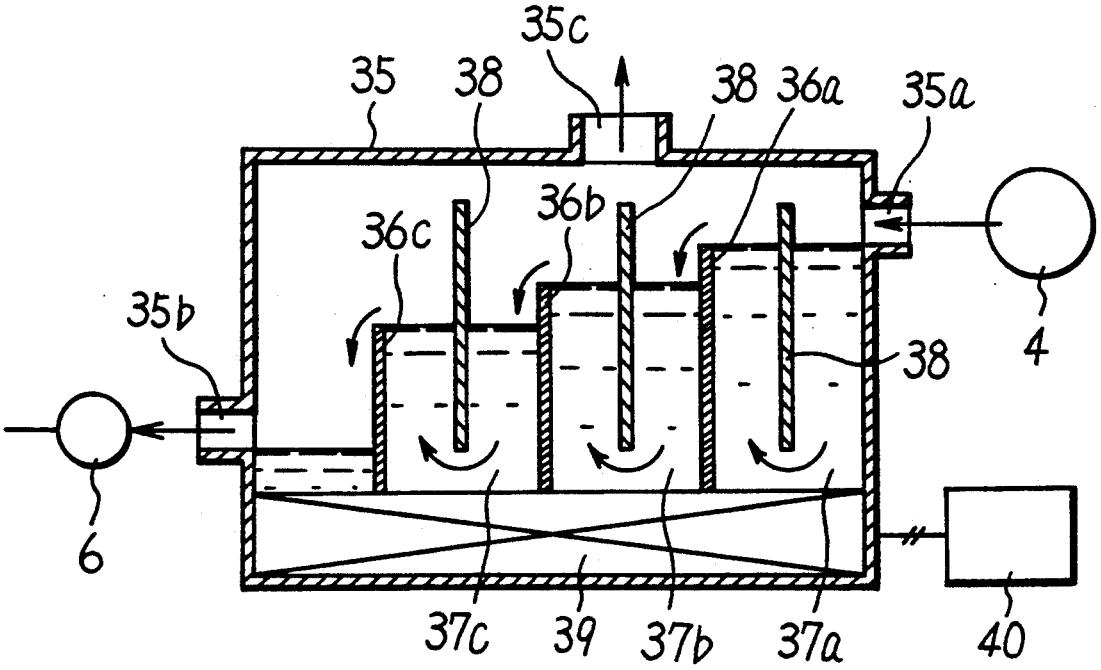

Further, shown in FIG. 5 is another example of the deaerator 5, having a deaeration vessel 35 which is provided with D.I. water inlet 35*a* and outlet 35*b* at different levels and divided into a plural number of chambers 37*a* to 37*c* by a number of partition plates 36*a* to 36*c* with a height reduced stepwise toward the D.I. water outlet 35*b*. Each one of the chambers 37*a* to 37*c* is further divided by a partition plate 38 which is open at its lower end, and provided with an ultrasonic transducer device 39 which is connected to an ultrasound generator 40. In this instance, while D.I. water supplied to the inlet 35*a* is allowed to flow under and over the respective partition plates toward the outlet 35*b*, ultrasound energy is applied thereto. At this time, air bubbles which are produced by cavitation grow larger by trapping dissolved air as they float up to the surface, deaerating D.I. water before leaving the vessel through the outlet 35*b*. The gases resulting from the deaeration is discharged through a gas outlet 35*c*.

The deaerator 5 is controlled by the above-mentioned control unit 9 in the manner as described below.

Generally, the maximum air solubility in water, namely, the saturated air solubility is known as indicated in Table 1 below. In this table, the column A shows the solubility (ml) of air in 1 ml of solvent at t° C. with the total pressure of gas phase at 760 mmHg, and the column B shows the corresponding values at 0° C. and 760 mmHg. The values given in this table are plotted in the graph of FIG. 6.

| Temperature (t) °C. | A ($1 \times 10^{-2}$) | B ($1 \times 10^{-2}$) |
|---|---|---|
| 0 | 2.86 | 2.86 |
| 10 | 2.32 | 2.24 |
| 15 | 2.21 | 2.01 |
| 20 | 1.96 | 1.83 |
| 25 | 1.82 | 1.67 |
| 30 | 1.71 | 1.54 |
| 40 | 1.51 | 1.32 |
| 50 | 1.34 | 1.14 |
| 60 | 1.195 | 0.98 |
| 70 | — | — |
| 80 | 0.78 | 0.60 |
| 90 | — | — |
| 100 | 0.00 | 0.00 |

Figure 6:
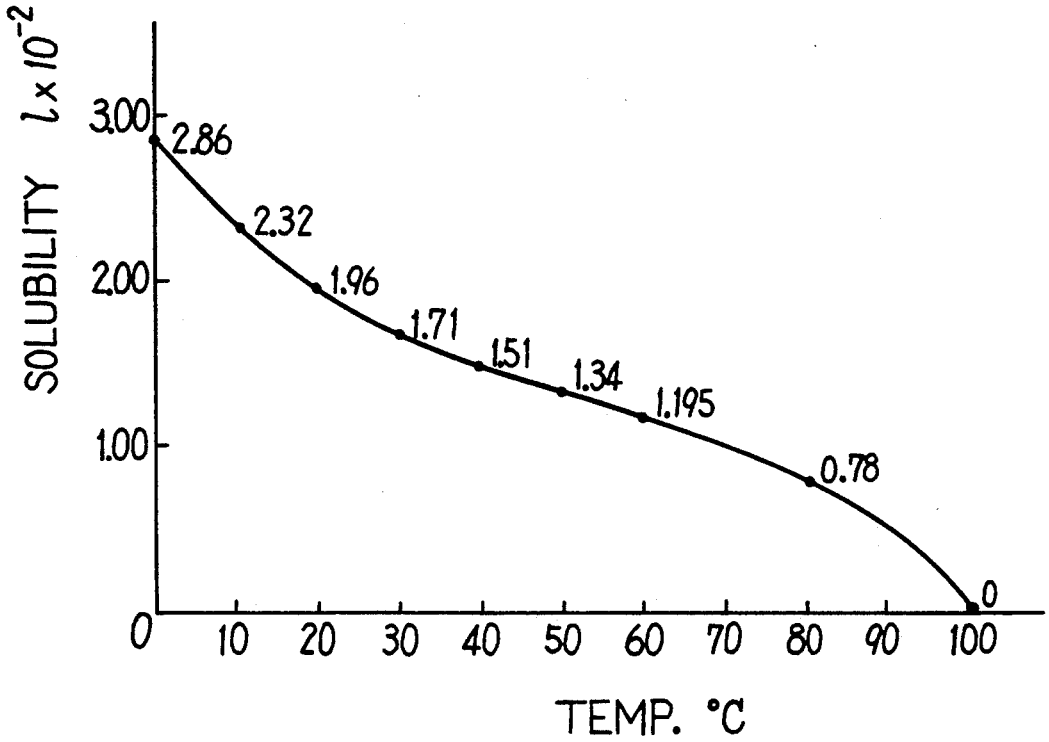
FIG. 6 is a diagram of air solubility in water.

As clear from the foregoing table and the graph of FIG. 6, the solubility of air in water varies depending upon the temperature. Therefore, it is considered that, when heating D.I. water to a predetermined temperature to obtain hot D.I. water, the generation of air bubbles in the heating operation can be suppressed by adjusting the dissolved air concentration in the D.I. water feed beforehand to a value smaller than the maximum solubility at the predetermined temperature, namely, to a range below the saturation curve of FIG. 6. For example, in a case where the hot D.I. water temperature is set at 60° C., since the maximum solubility of air in heated water at that temperature is approximately 0.01195 ml/ml, the dissolved gas content in D.I. water should be adjusted to a value smaller than the maximum solubility, for instance, to a value smaller than 0.011/l.

Accordingly, the control unit 9 is arranged to hold the dissolved air concentration in D.I. water to a value smaller than the saturation level at a given heating temperature prior to heating same by the heater 7. According to input data regarding the target values of dissolved air concentration at various hot D.I. water temperatures and on the basis of the dissolved air concentration measured by the densitometer 6, the control unit 9 functions to control the deaerator 5 in such a manner as to make the dissolved air concentration as close as possible to a target value at a given temperature, more specifically, at a value equivalent to or slightly smaller than the maximum solubility at that temperature.

When actually heating D.I. water, it is often the case that the surface temperature of the heater becomes slightly higher than the D.I. water temperature. For example, in a case where the target heating temperature is 60° C., the surface temperature of the heater may rise to about 80° C., elevating the D.I. water temperature to a level higher than the preset value in the regions close to the heater. In order to prevent generation of air bubbles in the high temperature regions in a more reliable manner, the above-mentioned target value may be set on the basis of the solubility at a temperature of the heater surface or at a temperature higher than the predetermined heating temperature, instead of the solubility at the predetermined temperature.

Thus, the control of the deaerator 5 by the control unit 9 is effected by adjusting the evacuation capacity of the vacuum pump 23 or 31 in a case where the deaerator 5 is of the membrane type or reduced pressure type, and by adjusting the vibratory output of the ultrasonic generator 40 in a case where the deaerator 5 is of the ultrasonic type. As typically shown in FIG. 2, the evacuation capacity of the vacuum pump 23 or 31 can be easily varied by controlling rotational speed of the pump-driving motor through an invertor attached to the vacuum pump 23. As an alternative means for controlling the degree of deaeration, a leak valve 16 may be provided in a conduit between the reduced pressure chamber 22 and vacuum pump 23, controlling the leakage rate of the leak valve 16 through the control unit 9.

As for the densitometer 6, a dissolved oxygen densitometer having a diaphragm type sensor can be suitably used when the target gas is air.

If desired, the deaerator 5 may consist of a plural number of deaerator units of the same type or of different types.

On the other hand, the hot D.I. water bath 1 is provided with a water collecting gutter or groove 50 around its upper edges to collect overflowing D.I. water. A pipe 51 is connected to the groove 50 to discharge overflowing hot D.I. water to the outside. In this instance, a heat-resistant filter 52 may be provided in the collecting pipe 51 to strain impurities out of hot D.I. water before returning same to the heater 7 or D.I. water source 4 for recirculation.

Formed over the hot D.I. water bath 1 is a drying chamber 53 which is enclosed by partition walls 54. This drying chamber 53 serves to accelerate the drying speed of the work 55 lifted out of hot D.I. water W. Through an exhaust pipe 57 which is connected to an exhaust port 56, the drying chamber 53 is connected to an exhaust fan 59 via mist catch 58. Steam which is released from the water surface and the surface of the work 55 is sucked and discharged through the exhaust pipe 57, thereby preventing the work 55 from being wetted again by contact with steam. In this regard, for the purpose of sucking steam substantially in a horizontal direction, which prevents undesirable contact with the work effectively, the drying chamber 53 is interiorly provided with a plural number of flaps 60 the angle of which are adjustable to create horizontal air flows. D.I. water collected in the mist catch 58 is discharged through a drain duct 61 into the afore-mentioned collecting pipe 51.

In the drawing, the reference 62 indicates a lift basket for holding the work 55, and 63 indicates a conveyer arm for transferring the work 55 in the basket 62, the conveyer arm 63 having a hanger hook 64 for suspending the basket 62 thereon. The hanger hook 64 is lifted up and down by a feed screw 65 along guide rods 66.

The drying apparatus with the above-described hot D.I. water bath is normally located posterior to a washing machine, drying a wet work 55 with use of hot D.I. water in the manner as follows.

Namely, D.I. water free of impurities is fed from the D.I. water source 4 to the deaerator 5 to reduce dissolved air and then heated to a predetermined temperature by the heater 7 to obtain hot D.I. water, which is continuously fed to the hot D.I. water bath 1 at a constant feed rate through the water inlet 1*a*. Overflown D.I. water is received in the water collecting groove 50 and discharged through the recovering pipe 51.

Since the dissolved air concentration in D.I. water is reduced to the saturation level at the heating temperature level prior to heating by the heater 7, no air bubbles occur in the heating stage to preclude disturbances of the water surface which would otherwise be caused by air bubbles climbing up to the water surface.

The reduction of dissolved air concentration also contributes to enhance the heat efficiency of the heater 7, accelerating the elevation of temperature in the heating operation, and to lower the surface temperature of the heater 7 in maintaining hot D.I. water at a given temperature.

On the other hand, air in the drying chamber 53 is sucked out by the exhaust fan 59, while the steam which has evaporated from the water surface is discharged horizontally, entrained on the exhaust air streams.

In this state, a work 55 is transferred to a position above the hot D.I. water bath 1 in a basket 62 which is suspended from a hook 64, and then the arm 63 is lowered to immerse the work 55 in the bath of hot D.I. water W together with the basket 62. After heating the work 55 in the bath of hot D.I. water W for a predetermined time period, the transfer arm 63 is lifted slowly to pull out the work 55 at a speed which is low enough to avoid rippling of the water surface. As a result, water depositing on the surface of the work 55 is pulled and taken back into the bath by its surface tension as the latter is lowered at a suitable relative speed. The surface of the work 55 which is still in a slightly wet state dries up sequentially by the heat of the work 55 itself as the work 55 is pulled out of the hot D.I. water bath, namely, by the hot D.I. water drying. On the other hand, in the drying chamber 53, steam rising from the water surface by evaporation is discharged substantially in a horizontal direction by the exhaust fan 59, without contacting the work 55. Therefore, there is no possibility of the work surface being re-wetted with steam which might otherwise result in non-uniform drying or stains.

After the work 55 has been lifted completely clear of the hot D.I. water bath, the work lifting speed may be increased as compared with the above-described pull-out speed, to perform the following operations more speedily.

For the purpose of trapping air bubbles which might be generated due to an unforeseeable cause, an air bubble trapping chamber 67 may be provided in the heated water feed pipe 3 between the heater 7 and hot D.I. water bath 1, or alternatively a bubble trap 67 may be provided in the hot D.I. water bath 1 in such a manner as to cover the water inlet 1*a*, as shown in FIG. 1, thereby collecting air bubbles and discharging them to the outside.

Figure 7:
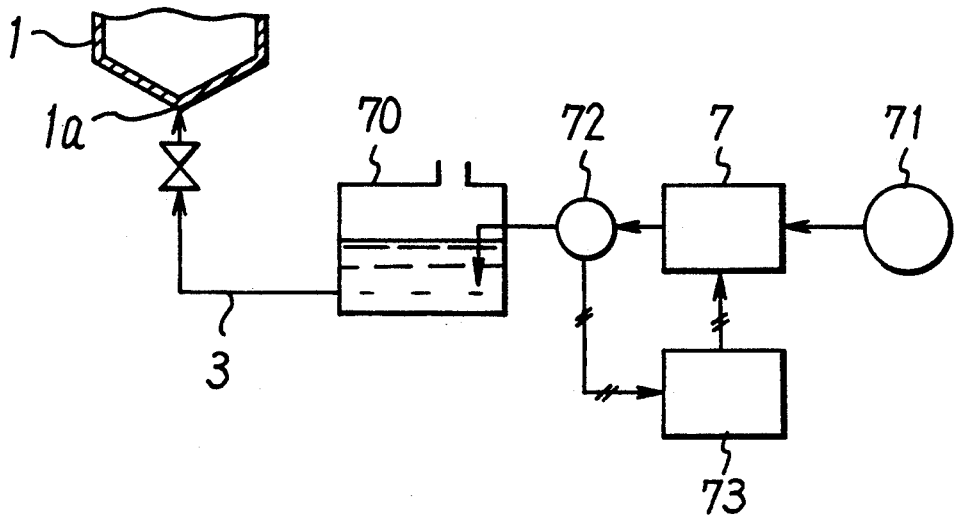
FIG. 7 is a diagrammatic view of another embodiment of the invention.

Although the dissolved air concentration in feed D.I. water is adjusted at a point upstream of the heater 7 in the foregoing embodiment, it is also possible to heat feed D.I. water to a preset temperature without prior adjustment of the dissolved air concentration and to removed air bubbles from hot D.I. water at a point upstream of the hot D.I. water bath 1. FIG. 7 shows an embodiment which is arranged to this effect. Namely, in the embodiment of FIG. 7, a bubble trapping chamber 70 of suitable construction is provided within the length of the water feed pipe 3 between the heater 7 and hot D.I. water bath 1 thereby to remove air bubbles from hot D.I. water before supply to the bath 1. In this figure, indicated at 71 is a D.I. water source, at 72 is temperature sensor and at 73 is a control unit which controls operation of the heater 7.

What is claimed is:

1. A method of drying a wet work with hot deionized water, comprising:

removing dissolved gases from deionized water by deaeration to a level below a saturated gas solubility at a predetermined temperature;

heating deaerated deionized water to said predetermined temperature by the use of a heater;

supplying resulting deaerated hot deionized water to a hot deionized water bath;

immersing a wet work in said hot deionized water bath; and lifting said work out of said bath to drain and dry said work.

2. A method of drying a wet work with hot deionized water, comprising:

heating deionized water to a predetermined temperature;

supplying hot deionized water to a hot deionized water bath through a water supply duct containing a bubble trapping chamber to remove air bubbles therefrom;

immersing a wet work in said hot deionized water bath; and lifting said work out of said bath to drain and dry said work.

3. An apparatus for drying a wet work with hot deionized water, said apparatus including a hot deionized water bath for immersing a work, and a hot deionized water supply means for supplying hot deionized water of a predetermined temperature to said bath, characterized in that said hot deionized water supply means comprising:

a deionized water source;

a deaerator for removing dissolved gases from deionized water to be supplied to said bath;

a densitometer for measuring dissolved gas concentration in deionized water coming out of said deaerator;

a controller adapted to control said deaerator to hold said dissolved gas concentration in deionized water to a level below a saturated gas solubility at a predetermined temperature, on the basis of said dissolved gas concentration measured by said densitometer and said temperature of hot deionized water; and a heater for heating up deaerated deionized water to said predetermined temperature level.

4. A drying apparatus as defined in claim 3, wherein said deaerator is constituted by a deionized water passage formed of a gas permeable membrane permitting passage of gases but not of a liquid, and a reduced pressure chamber circumventing said deionized water passage, stripping and sucking dissolved gases out of deionized water flows in and along said deionized water passage through said gas permeable membrane while evacuating said reduced pressure chamber by means of a vacuum pump.

5. A drying apparatus as defined in claim 4, wherein said deionized water passage is constituted by a plural number of air separator tubes each formed of a gas permeable membrane.

6. A drying apparatus as defined in claim 4, wherein said deionized water passage is constituted by a hollow gas separator sheet accommodated in a folded state within said reduced pressure chamber.

7. A drying apparatus as defined in claim 3, wherein said deaerator has a vacuum pump connected to a deaeration vessel, and adapted to remove dissolved gases from deionized water within said deaeration vessel under reduced pressure.

8. A drying apparatus as defined in claim 3, wherein said deaerator is provided with an ultrasonic vibratory element within a deaeration vessel, and adapted to deaerate deionized water by applying ultrasound energy to deionized water flowing through said deaeration vessel.

9. A drying apparatus as defined in claim 8, wherein said deaeration vessel is divided into a plural number of chambers by a plural number of partition plates arranged stepwise between water inlet and outlet of said vessel in such a manner as to have a smaller height toward said water outlet, each one of said chambers being divided into subchambers by a partition plate having an opening at the lower end thereof and being provided with an ultrasound vibratory device.

10. An apparatus for drying a wet work with hot deionized water, including a hot deionized water bath for immersing a work therein, and a hot deionized water supply means for supplying hot deionized water of a predetermined temperature to said bath, characterized in that said hot deionized water supply means comprises:

a heater for heating up deionized water to a predetermined temperature; and an air bubble trapping chamber adapted to collect air bubbles generated in deionized water being heated.

11. An apparatus for drying a wet work with hot deionized water, comprising a hot deionized water bath for immersing a work therein, a water inlet associated with said bath and a bubble trap within said water bath covering said water inlet to collect air bubbles and discharge them to the outside of the water bath.

12. An apparatus for drying a wet work with hot deionized water, comprising a hot deionized water bath for immersing a work therein and a hot deionized water supply means for supplying hot deionized water to said bath and a deaeration means for removing dissolved gasses from the deionized water supplied to said bath.

* * * * *